US007377064B2

(12) United States Patent
Burke

(10) Patent No.: US 7,377,064 B2
(45) Date of Patent: May 27, 2008

(54) TOWER BANNER DISPLAY SYSTEM AND APPARATUS

(76) Inventor: Edward A. Burke, 13 Triluum Lake, Utopia (CA) L0M 8T0

( * ) Notice: Subject to any disclaimer, the term of this patent is extended or adjusted under 35 U.S.C. 154(b) by 0 days.

(21) Appl. No.: 11/452,201

(22) Filed: Jun. 14, 2006

(65) Prior Publication Data

US 2006/0288618 A1 Dec. 28, 2006

(51) Int. Cl.

| | |
|---|---|
| ***G09F 7/00*** | (2006.01) |
| ***G09F 17/00*** | (2006.01) |
| ***G09F 15/02*** | (2006.01) |
| ***G09F 7/22*** | (2006.01) |
| ***A47H 1/10*** | (2006.01) |
| ***B21F 27/00*** | (2006.01) |
| ***E04H 17/02*** | (2006.01) |

(52) U.S. Cl. ..... 40/601; 40/607.04; 40/603; 40/604; 40/617; 248/329; 248/332; 248/333; 254/46

(58) Field of Classification Search ..... 40/601, 40/604, 603, 606.12, 607.01, 607.03, 610.617, 40/610, 617, 538; 211/1.3; 248/910; 242/397, 242/397.5, 397.3; 52/105

See application file for complete search history.

(56) References Cited

U.S. PATENT DOCUMENTS

| | | | | |
|---|---|---|---|---|
| 3,938,269 A * | 2/1976 | Catteau | ..... | 40/601 |
| RE38,463 E * | 3/2004 | Anderson et al. | ..... | 248/329 |
| 7,121,029 B2 * | 10/2006 | Wilson | ..... | 40/601 |

* cited by examiner

*Primary Examiner*—Lesley D. Morris
*Assistant Examiner*—Syed A Islam
(74) *Attorney, Agent, or Firm*—D. W. Eggins

(57) ABSTRACT

A banner is displayed about a tower structure, such as a water tower, by a system that enables ready substitution or replacement of the banner, without the use of high-lift equipment. The fabric banner is segmented, of wind permeable stretchable fabric, and mounted on rings that are carried on cables, suspended from a capstan atop the tower. Cable guidance pulleys, mounted on trolleys that run on a peripheral track about the top of the tower, enable the banner to be reoriented about the tower. The capstan and trolleys may be remotely controlled.

9 Claims, 3 Drawing Sheets

TOWER BANNER DISPLAY SYSTEM AND APPARATUS

CROSS REFERENCE TO RELATED APPLICATIONS

Not Applicable (N/A)

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

1. This invention is directed to a system for mounting visual displays upon tall structures such as towers, and to the associated display and its mounting apparatus.

2. Visually prominent structures such as towers form a useful and attractive basis for visual displays such as advertisements. In the past, in the case of structures such as water towers, the large, elevated surface of the tank has been utilized, usually by way of painting. Murals as well as identifying-names of Companies or towns and cities have been applied in this manner. Also, pressure sensitive adherent vinyl has been applied to the tank surface, bearing the desired information or decoration.

In both instances, the application of the material has required the erection of scaffolding trusses, with associated extensive labour, both in the erection of a working platform, and in the subsequent application of the paint, or the vinyl liner. In the case of the vinyl, these materials are often subject to delamination, with consequent deterioration and destruction, with associated high labour costs for removal and replacement.

It should be born in mind that generally, over the course of time, these costs reoccur.

BRIEF SUMMARY OF THE INVENTION

The present invention provides a system for utilizing a tall structure as a visual display site, and in particular for displaying a banner upon such tall structures. The subject system includes the provision of display structure for deploying a banner from a tower structure. The system conveys the inherent advantage of ready substitution or replacement of the display, without requiring the use of specialized high-lift equipment. The subject system enables rapid changes being made to the perceived display.

The use of a banner made of fabric includes the advantages of: preparing a banner or a replacement banner off-site, as in a factory environment, which enables precise digital printing of the display artwork to photographic quality standards; a banner can be made in mutually detachable segments that are zipped or Velcro'd™ together on-site, in order to achieve the desired large size, and the ability to 'wrap' about a tower.

The use of a wind-permeable, multi-directional fabric perforated for wind penetration minimizes the effect of wind forces on the banner, when displayed; the perforated material readily lends itself to the sewing-on of pennants and other extraneous add-ons, to achieve various visually novel effects.

Such perforated, wind-permeable fabrics may also be illuminated after dark by way of back-lighting.

Such effects may be heightened by way of translucent fabric material that can achieve a neon-effect when back-lighted.

The use of the subject system also enables the provision of two or more banners in side by side relation, suspended from the supporting structure, so as to display them one at a time when viewed from an adjacent vantage point, such as an adjacent highway.

The subject banner suspension system serves as a template, to enable cost-effective overnight changing of a banner. This is a powerful attraction for advertising sponsors.

In one embodiment, the subject tall structure is a water tower. The use of a banner, draped over depending support rings enables the virtual utilization for display purposes, of support surfaces of the tower that otherwise could not be readily or economically used.

The subject suspension system provides a series of peripherally spaced suspension cables from which one or more spacer rings depend, which rings encircle the tower structure, and can be selectively raised or lowered. An encircling banner that is attached to the rings can be drawn up to the top of the tower, to provide a draped display that may encompass substantially the whole of the tower.

In a preferred embodiment, the suspension cables each passes over a trolley-mounted guide pulley. A peripheral track enables the draped display to be selectively moved around the tower. A remotely controlled towing carriage can relocate the connected string of trolleys, to reposition the draped display banner in oriented relation to a desired viewing-point or viewing zone, such as an adjacent highway.

A remotely controlled capstan tower mounted upon the tower structure, to which the suspension cables are secured, enables the selective taking-up or letting down of the display banner.

It will be clear to one skilled in the art that the subject system lends itself to use with other types of tall structure.

BRIEF DESCRIPTION OF THE SEVERAL VIEWS OF THE DRAWINGS

Certain embodiments of the invention are described by way of illustration, without limitation thereto other than as set forth in the accompanying claims, reference being made to the accompanying drawings, wherein

DETAILED DESCRIPTION OF THE INVENTION

Figure 1:
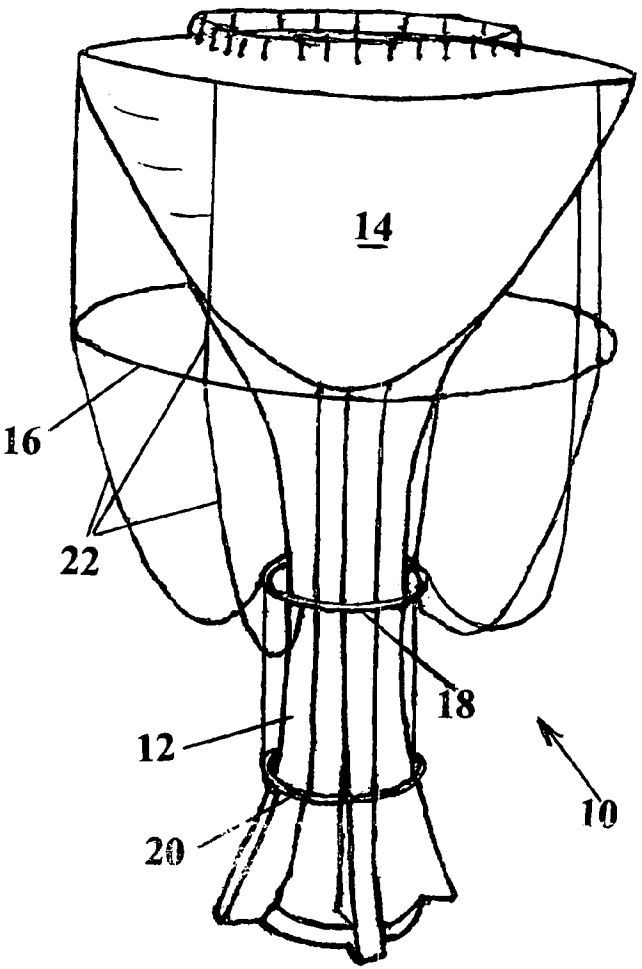
FIG. 1 is a perspective view of a water tower, showing ring elements of the present invention in suspended intermediate positions, prior to the application of display banner elements in suspended relation therewith.
Figure 2:
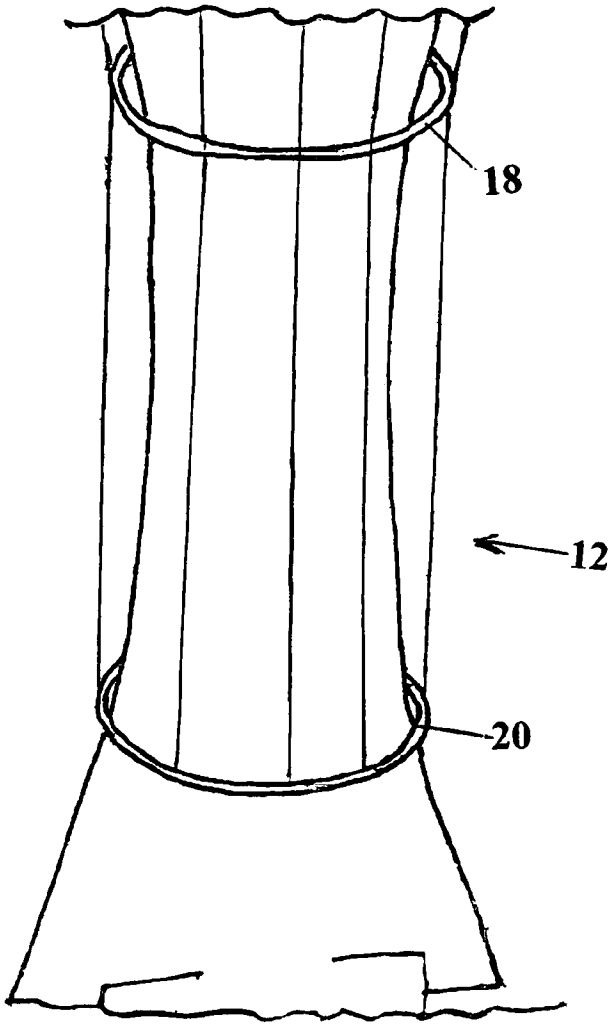
FIG. 2 is an enlarged view of a portion of the FIG. 1 embodiment.
Figure 3:
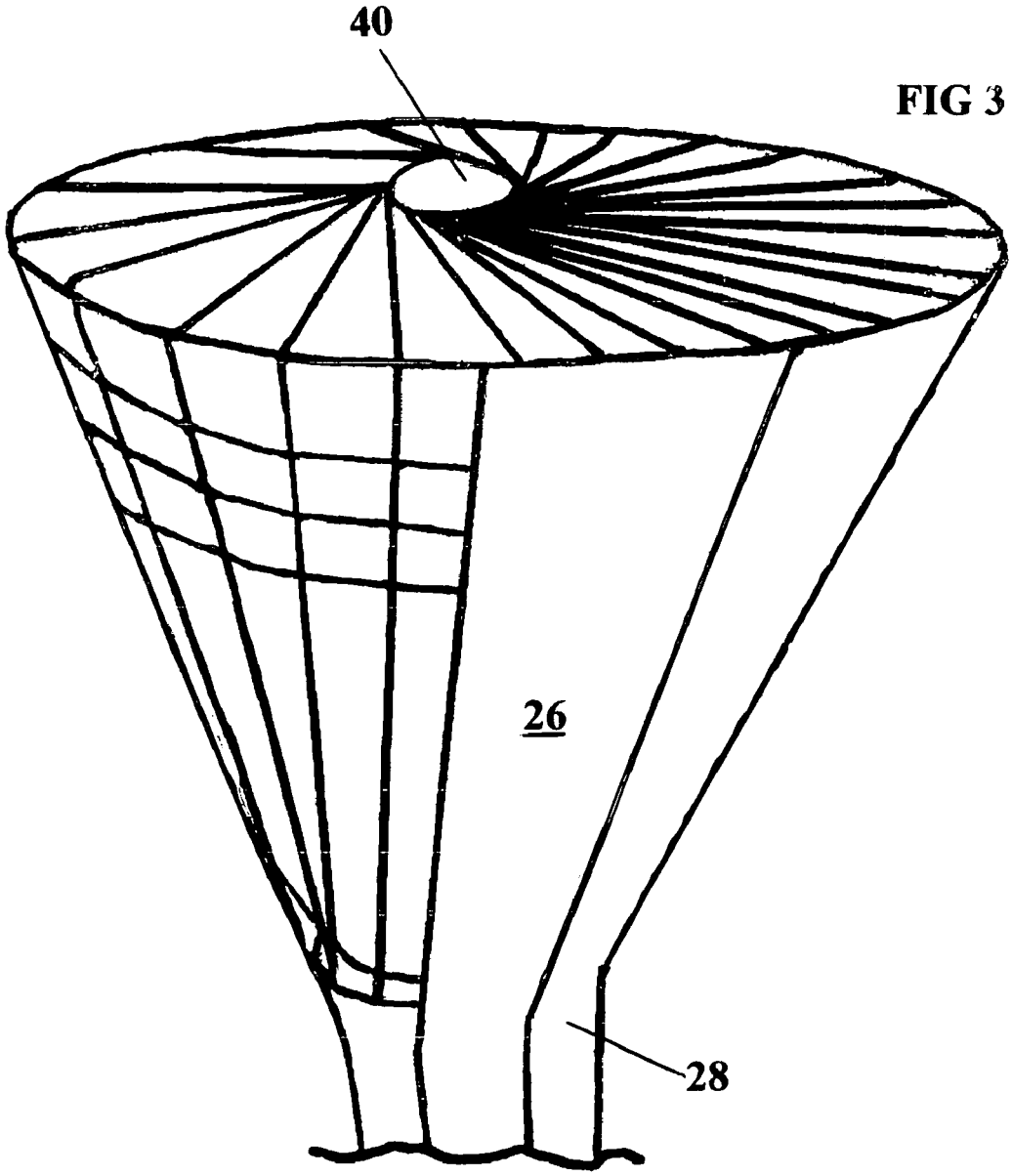
FIG. 3 is a schematic view of a top portion of a tower, in a partially "clad" condition, and illustrating the arrangement of suspension cables.

Referring to FIG. 1, a tower 10 is of well known construction, having a cruciform plinth support structure 12, capped by a tank 14 of bowl-like section. In accordance with the present invention a major spacer ring 16 and lower, minor spacer rings 18, 20 are carried on a plurality of mutually spaced suspension cables 22. The spacer rings 16, 18, 20 may each comprise a series of rods connected end-to-end. With the cables 22 in a lowered condition, the major ring 16 is lowered to ground level, where segments 26, 28 (see FIG. 3) of a banner can be attached to the ring 16, and mutually zipped or otherwise secured together at their seams (as by hook and eye e.g. "Velcro" ™), to provide a peripheral banner 30, that conforms to the general shape of the tower 10. The lower ring 20, to which the banner is attached, may engage the plinth support structure 12.

Figure 4:
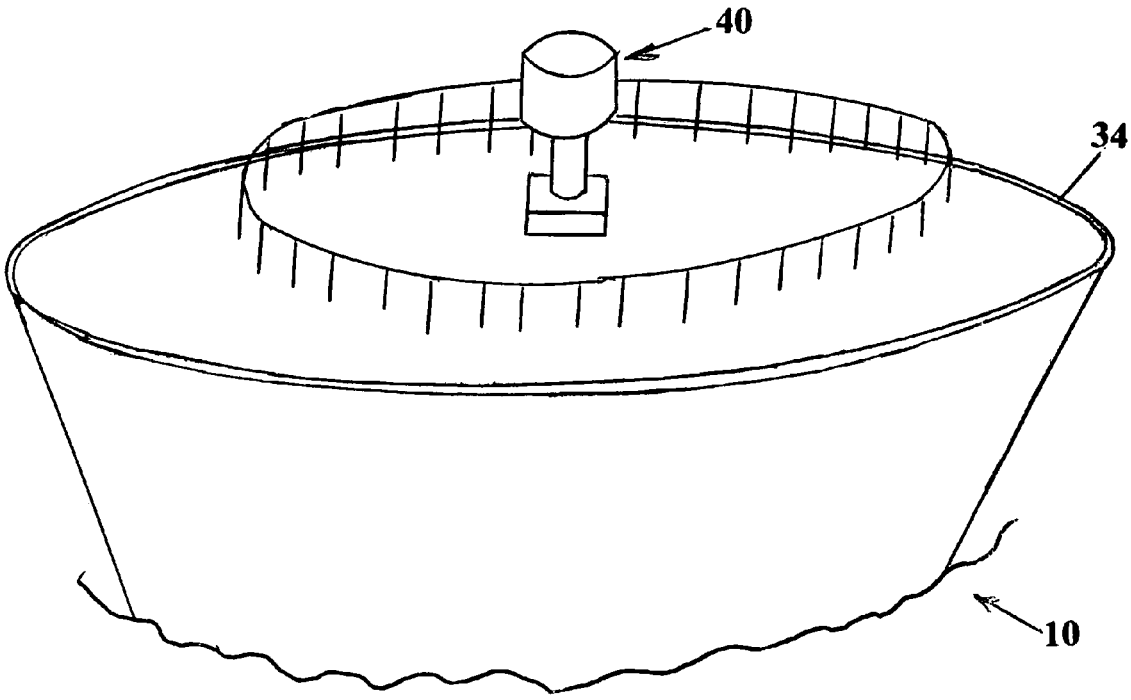
FIG. 4 is a perspective view showing a tower top portion with a peripheral track and centrally located capstan.
Figure 6:
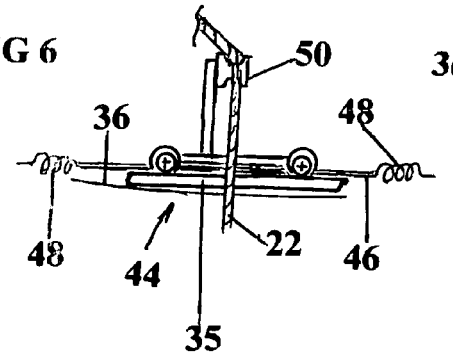
Figure 5:
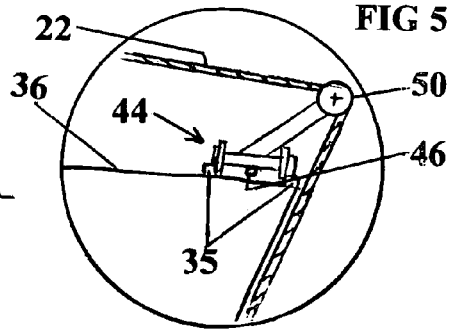
FIG. 5 is a scrap view showing a trolley-mounted guide pulley located upon a peripheral track; and, FIG. 6 is a side view of the FIG. 5 embodiment.

Referring to FIGS. 4, 5 and 6, atop the tower 10, a peripheral track 34 comprises a pair of rails 35 secured to the top surface 36 of the tank. The rails 35 may comprise a plurality of segment joined end to end with quick-disconnect joints. In the case of a concrete tank 14, securing flange plates (not shown) are rag-bolted to the tank top 36. For a metal tank 14 the flange plates may be spot-welded to the surface 36 of the tank.

A reversible vertical (tower) capstan 40 is illustrated as being centrally mounted on the tower 10, to which the cables 22 are attached. The capstan 40 is shown elevated, so that the attached cables are clear of the tank superstructure (a fenced safety enclosure) in which the capstan 40 is located.

A series of trolleys such as trolley 44 are mounted in equally spaced relation about the track 34, being releasably clamped to a peripheral cable 46, which circles the track 34. Intermediate tensioning springs 48 serve to maintain stability of the system, and to compensate for size changes due to ambient temperature variations.

Each trolley 14 has an elevated grooved pulley 16 over which a respective cable 22 passes, in guided relation to the capstan 40.

At least one of the trolleys 14 has a remotely controlled, reversible motor, enabling the trolley system to be selectively positioned and repositioned about the track 34. By this means, the relative locations about the tower 10 of the banners 26, 28 may be collectively, selectively controlled.

In use, the capstan 40 is driven in reverse, to unwind the cables 22 to a sufficient extent to lower the rings, with ring 16 going substantially to ground level, and the rings 18, 20 resting upon the tower plinths structure 12.

The respective banners or banner segments 26, 28, etc etc are attached at their top ends to the ring 16, and their adjoining vertical edge seams are progressively zipped together in joined relation to form a tower-enclosing banner as the ring 16 is progressively hoisted by actuation of the capstan 40. This process enables the installation of a banner or banner segments, or for its changing, to be carried out at ground level, without recourse to any high-level equipment such as cranes or the like. It may prove desirable to access the lower ring 20 by ladder or cherry-picker to secure the lower edges of the banner segments 26, 28, etc, etc to that ring 28. However, magnetic pads may be used for that purpose. It will be understood that the panels such as 26 and 28 may be profiled so as to form an envelope of revolution that substantially conforms to the shape of the tower.

The subject banner panels 26, 28, etc, etc preferably consist of a multi-stretch, open weave, wind-permeable fabric well suited to accept digitally printed graphics. In operation, when the remotely controlled trolley 44 is to be energized, in order to reposition the banners about the tower, compensatory adjustment of the capstan 40 is made, in order to avoid undue upward displacement of the banners 26, 28 as a consequence of such peripheral repositioning about the tower.

It will be understood by those skilled in the art that the above disclosure is directed primarily to specific embodiments of the present invention, and that the subject invention is susceptible of reduction to practice by those skilled in the art, in other embodiments that fall within the scope of the appended claims.

The invention claimed is:

1. A display system utilizing a tower structure to display a suspended banner in at least partially enclosing relation with the tower structure, said system having an adjustable supporting set of cables suspended from the tower; banner support means including at least one ring extending substantially horizontally and encompassing said tower and secured to said cables: banner panel portions attached to the banner support means, and cable adjustment means for selectively positioning the cables to position the banner panel portions at an elevated position upon the tower, for advantageous viewing.

2. The system as set forth in claim 1, including cable guide means for training said cables from a substantially vertical direction to a substantially horizontal direction consisting of a plurality of pulleys, each mounted upon a trolley; peripheral track means upon said tower in supporting relation with a plurality of said trolleys and positioned to locate said pulleys adjacent an outer edge portion of said tower.

3. The system as set forth in claim 2, including means securing said trolleys in mutually spaced, connected relation.

4. The system as set forth in claim 3, wherein at least one said trolley includes selectively operable means for repositioning said trolley along said track means.

5. The system as set forth in claim 4, including remote control means for selectively positioning said trolley.

6. The system as set forth in claim 1, wherein said tower is a water tower, having a support structure surmounted by a tank.

7. A method of displaying a banner from a tall structure, consisting of the steps of suspending a plurality of support cables in substantially evenly spaced relation about the top of said structure, said cables supporting a plurality of substantially horizontally extending rings, said rings being suspended in mutual, vertically spaced relation; with elements of said banner being in mutually arranged relation attached to at least one said ring to substantially conform about said at least one ring; and displacing said cables to reposition said rings, thereby moving said banner to an advantageous location for viewing.

8. The method as set forth in claim 7, wherein said cables are displaced by winding upon capstan means, to selectively position said banner elements vertically in relation to said tower.

9. The method as set forth in claim 8, wherein said cables are displaced substantially horizontally around said tower, to displace said banner elements peripherally about said tower, in selected viewing relation.

* * * * *